United States Patent [19]

Pitts et al.

[11] Patent Number: 5,060,429

[45] Date of Patent: Oct. 29, 1991

[54] CEILING-WALL ATTACHMENT

[75] Inventors: Norman L. Pitts, Ellisville; Raouf R. Sinno, Starkville, both of Miss.

[73] Assignee: Mid-South Industries, Inc., Laurel, Miss.

[21] Appl. No.: 541,994

[22] Filed: Jun. 21, 1990

[51] Int. Cl.[5] ..... E04B 2/00

[52] U.S. Cl. ..... 52/127.7; 52/235; 52/508

[58] Field of Search ..... 52/127.2, 126.6, 127.7, 52/127.9, 127.11, 235, 508

[56] References Cited

U.S. PATENT DOCUMENTS

| | | | |
|---|---|---|---|
| 3,943,674 | 3/1976 | Ray . | |
| 4,449,346 | 5/1984 | Tremblay . | |
| 4,506,482 | 3/1985 | Prachet et al. | 52/235 |
| 4,597,235 | 7/1986 | Olsen . | |
| 4,644,711 | 2/1987 | Eickhof | 52/235 |
| 4,678,910 | 4/1986 | Germeroth et al. . | |
| 4,738,067 | 4/1988 | Fröseth . | |
| 4,779,392 | 10/1988 | Hopeman . | |
| 4,903,454 | 2/1990 | Rose | 52/235 |

*Primary Examiner*—Richard E. Chilcot, Jr.
*Assistant Examiner*—Joanne C. Downs
*Attorney, Agent, or Firm*—David H. Semmes

[57] ABSTRACT

A supporting assembly for abutting insulating ceiling or wall panels which are camlocked together, comprising a structural support, a flanged spacer member secured between the structural support and the panels, and a thread rod extending longitudinally through the structural support, spacer member and panels, in threaded engagement with a tapped opening in the camlock. The disclosed assembly eliminates complete penetration or through bolting of the panels, preserves the integrity of the basketed panel joints, and allows simple access to the camlocks during panel erection.

10 Claims, 5 Drawing Sheets

CEILING-WALL ATTACHMENT

BACKGROUND OF THE INVENTION

1. Field of the Invention

Panel supporting structures, namely, an assembly for mechanically attaching insulating ceiling or wall panels to a structural support, such as a structural steel frame.

2. Description of the Prior Art

Large refrigerated and non-refrigerated rooms or buildings utilizing insulated, metal faced, tongue-in-groove, camlock and pin assembled roof and wall panels are required to meet the design criteria of most national and local building codes. These building codes require the building to be designed to effectively transmit external and internal forces, such as positive and negative wind forces, live and dead loads and seismic loads, with the total building system working to overcome or offset these required loads.

Also, with the type of panel described utilizing camlock and pin assemblies, access must be provided to the camlock in order to allow activation of the camlocks when erecting the panels around a steel structure frame.

In refrigerated rooms and buildings, maintaining complete insulation without requiring the complete penetration of the insulated panel or interfering with the gasketed panel joint is of the utmost importance in preserving the insulating efficiency of the panel systems.

Prior methods require the insulated panel to be through-bolted or screwed to the structural frame or require steel plates installed into the gasketed panel joints, with the steel plates attached to the steel structural frame by other structural components, such as angle or channel parts. Both methods create problems with the insulating efficiency of the panel, therefore, lower the overall insulating efficiency of the building.

SUMMARY OF THE INVENTION

The present invention meets the design criteria required to a) effectively attach by mechanical means the described panels to a structural steel frame;

b) allow proper spacing between the insulated panels and structural steel frame, thus allowing access to the camlocks for panel erection; and c) eliminate complete penetration of the insulated panel and eliminate, also, the need to interfere with or destroy the gasketed panel joints, thereby maintaining the insulating integrity of the panels.

The assembly of this invention employs existing components that are presently used in the manufacture of panels or are readily purchasable, with the exception of the spacer member, which can be made from sheet metal. The foregoing objects are attained by using a tap to form a thread in the hexagon hole of the panel camlock, such that a means for mechanically attaching the panels to a support is conveniently provided, without the need for through bolting or disturbing the gasketed panel joint of the panel members. In forming the assembly, a flanged spacer is placed between the structural support and the camlocked panels, and corresponding holes in the spacer flanges and structural support are aligned with the camlock hole in one of the panel members, such that a thread rod can be inserted through these corresponding openings, into the threaded camlock hole, and be secured against vertical or rotational movement.

DESCRIPTION OF THE PREFERRED EMBODIMENTS

Figure 3:
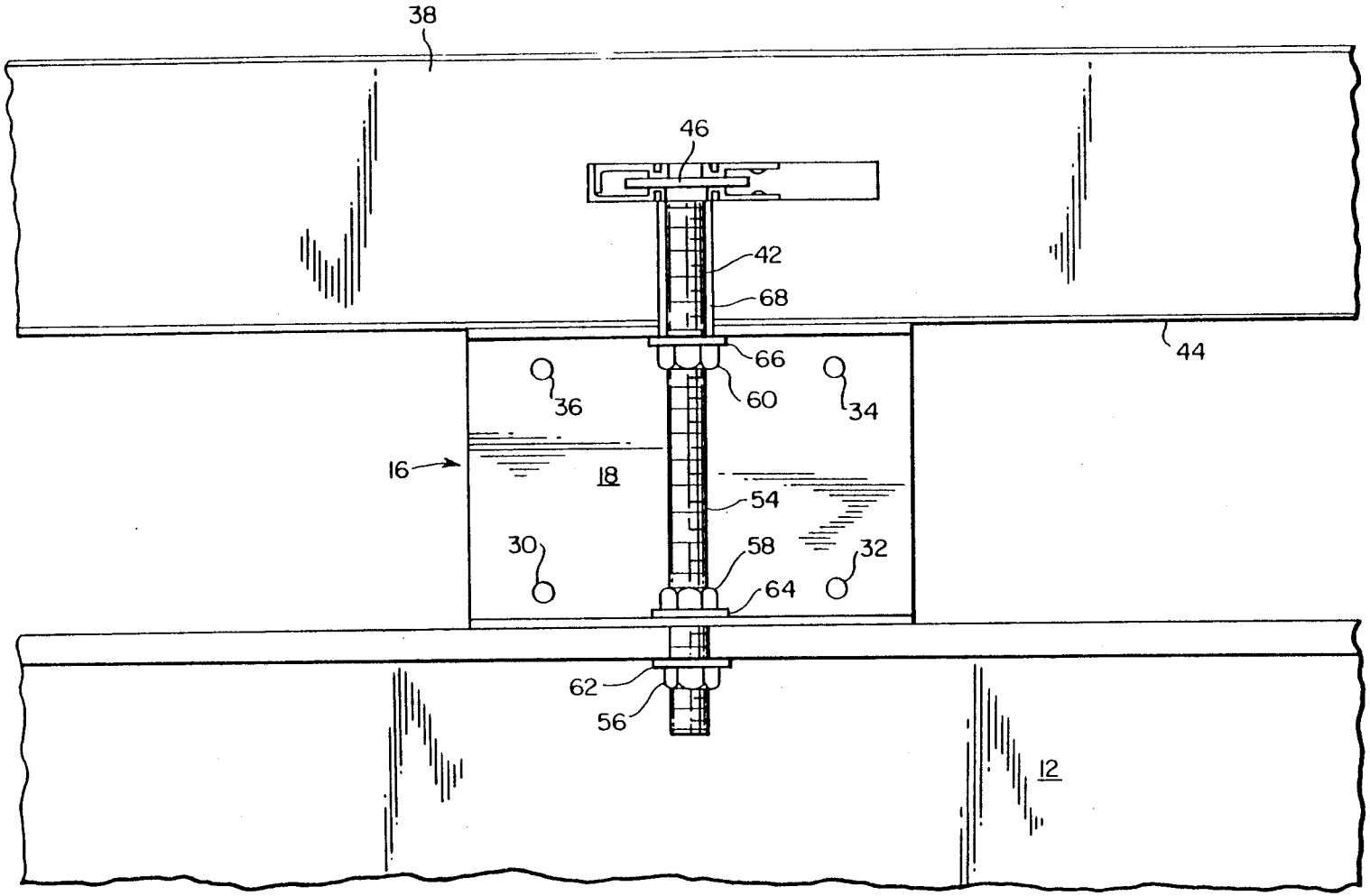
FIG. 3 is a partially fragmentary vertical sectional view taken through the front of the panel assembly.
Figure 4:
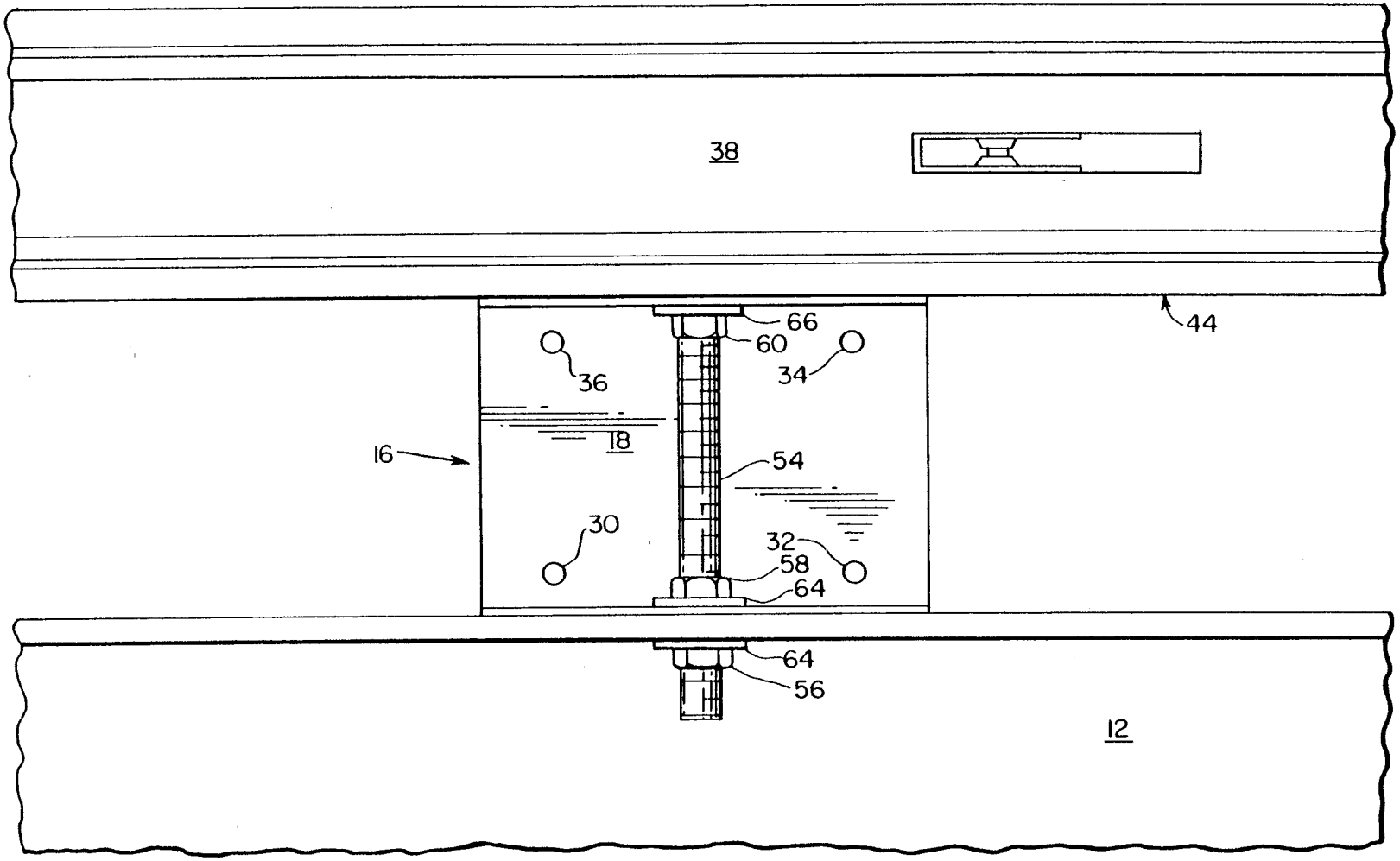
FIG. 4 is a front elevation of the panel assembly.

As shown in FIGS. 1 through 4, a panel assembly, indicated generally at 10, includes structural frame 12 consisting of a structural steel support. Structural frame 12 has upper surface 14 which supports a galvanized double channel spacer 16. Spacer 16 has respective front and rear channel members 18, 20. Front channel member 18 has outwardly extending upper and lower flanges 22, 24. Similarly, rear channel member 20 has upper and lower flanges 26, 28 which extend rearwardly. As best shown in FIGS. 3 and 4, rivets 30, 32, 34, 36 join channel members 18 and 20.

Supported on flanges 24, 28 of spacer 16 are first and second insulated, prefabricated panels 38, 40. Panel 38 includes an opening 42 extending longitudinally inwardly from a point on inner surface 44 to camlock hole 48 in camlock 46. Panel 40 is joined to panel 38 by camlock 46. Sheet metal screws 50, 51 penetrate inner surface 52 of panel 40 through an opening in flange 28 of spacer member 16, in order to secure panel 40 to the spacer member.

Figure 1:
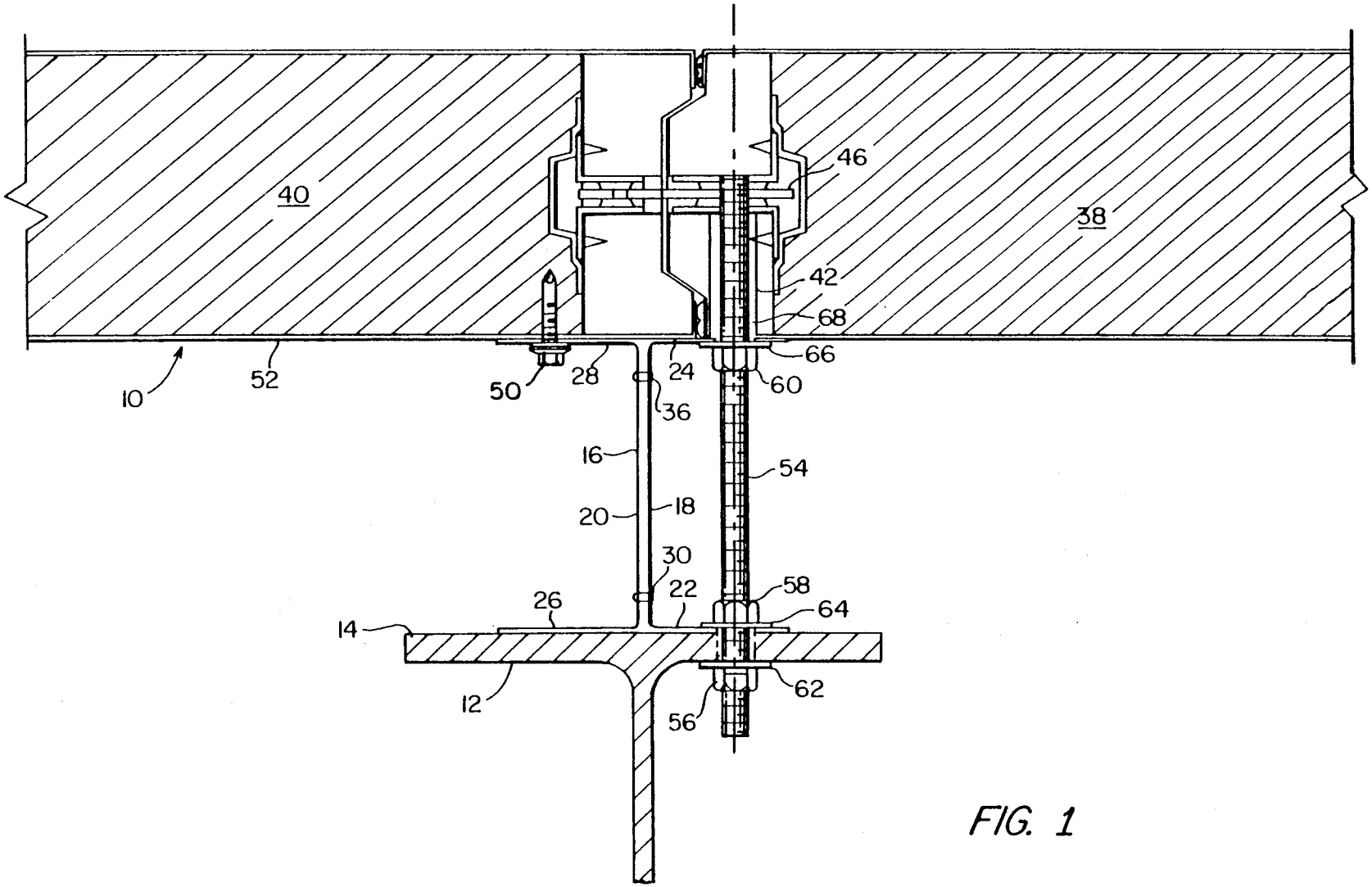
FIG. 1 is a partially fragmentary vertical sectional view taken through the side of the panel assembly of the present invention.
Figure 2:
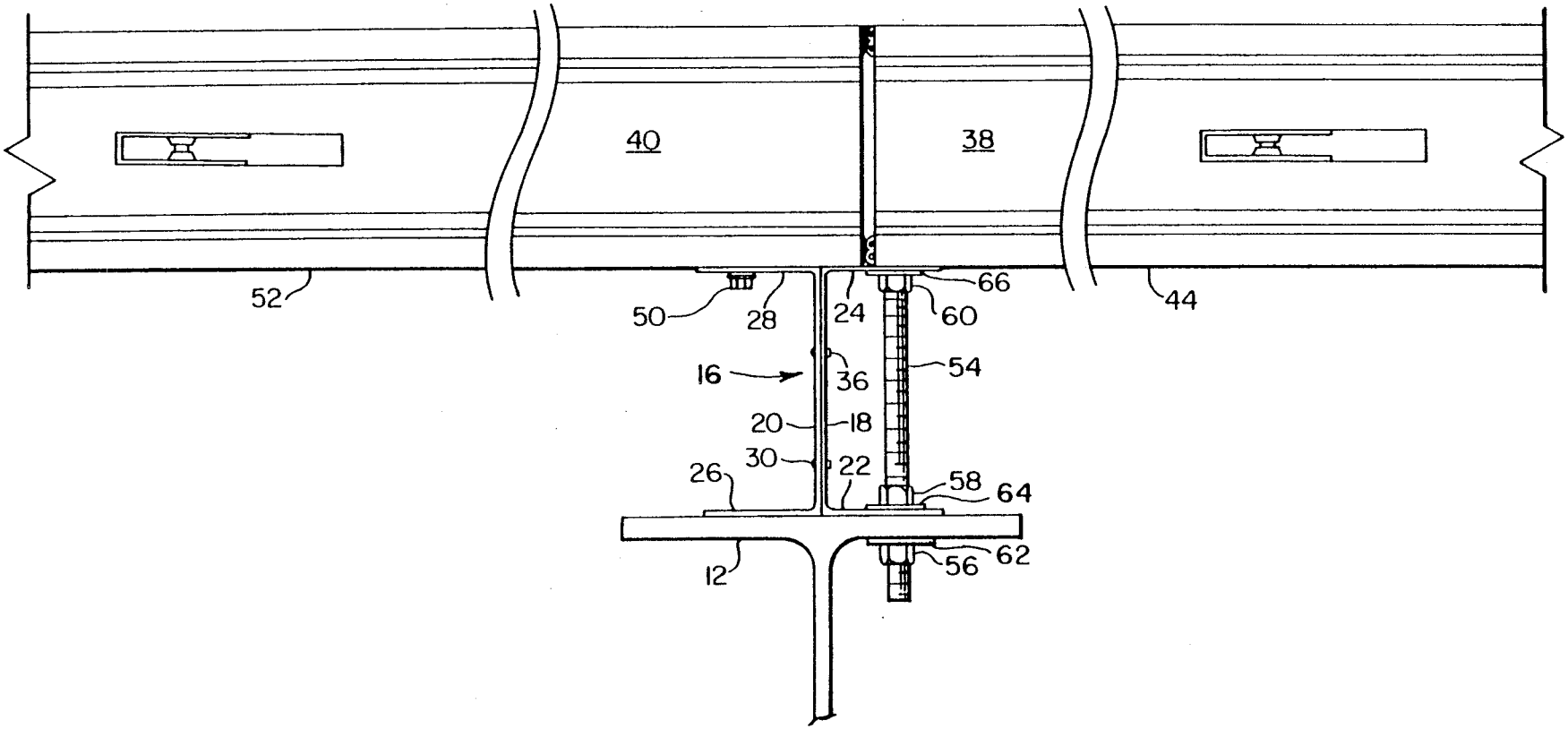
FIG. 2 is a side elevation view of the panel assembly.

A thread rod 54 extends longitudinally through structural frame 12 and openings in flanges 22, 24 of spacer member 16, thence into opening 42 in panel 38. Thread rod 54 further extends into threaded camlock hole 48 of camlock 46, such that panels 38 and 40 are securely supported relative to structural frame 12, when thread rod 54 is secured against vertical or rotational movement by means of nuts 56, 58, 60 and corresponding washers 62, 64, 66. As shown in FIGS. 1 and 3, opening 42 in panel 38 may contain a silicone sealant 68.

Figure 5:
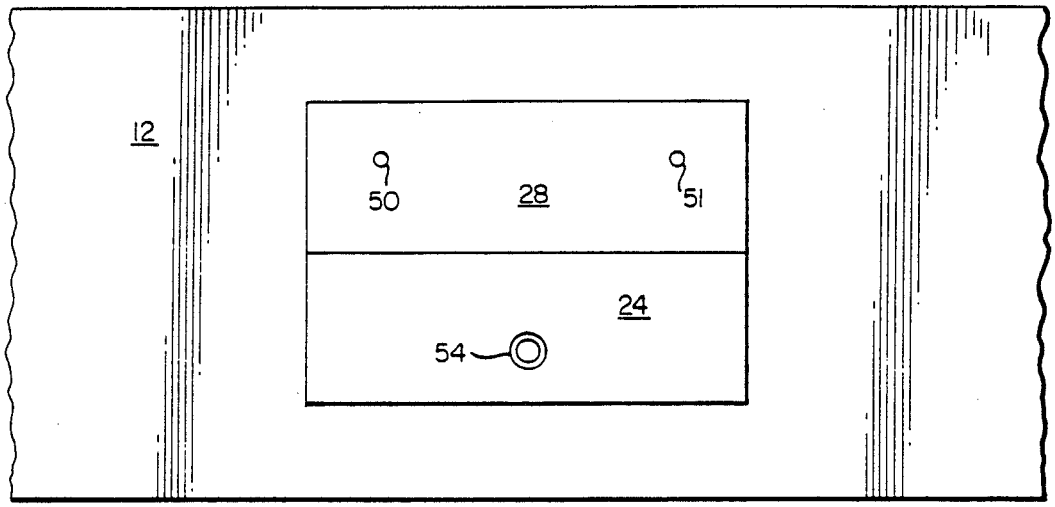
FIG. 5 is a top plan view of the structural frame and flange spacer of the assembly.

FIG. 5 is a top plan view of the assembly, showing flanges 24 and 28 of the spacer member, thread rod 54 and sheet metal screws 50, 51.

Figure 6:
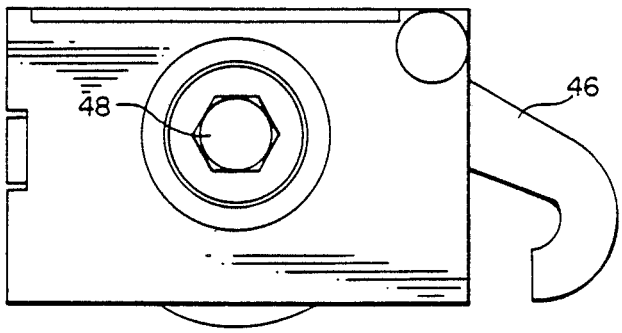
FIG. 6 is a plan view of the camlock with tapped hexagon hole.

FIG. 6 illustrates a plan view of the camlock 46 and tapped hexagon hole 48.

The preferred method of assembly will be given by the following example:

EXAMPLE

Each ceiling-wall anchorment requires the following:

One camlock with 7/16" hexagon hole capable of being threaded with a ⅜"-16 UNC tap.

One ⅜"-16 UNC steel all thread rod cut to proper length.

Three ⅜"-16 UNC hexagon nuts.

Three ⅜" steel flat washers.

One 4" high, 6" long double channel with 2" flanges, assembled from two 4" high by 6" long single channels by riveting together, back to back, with four ⅛" aluminum rivets.

Channel material is 16 guage G-90 galvanized steel sheet or coil stock.

The double channel spacer 18–20 is placed between the insulated panels 38, 40 and the structural steel frame 12. Panels 38, 40 are then camlocked together. The ½" diameter hole in the top flange of the double channel is aligned with camlock hole 42 in panel 38. A ½" O diameter hole is then drilled through the flange of the structural steel. One ⅜-16" UNC all thread steel rod 54 is then inserted through the ½" hole in the structural steel flange and the bottom hole of the double channel. Two ⅜" flat washers 62, 66 and two ⅜"-16 UNC hexagon nuts 56, 60 are installed onto the end of all thread rod 54. All thread rod 54 is then inserted into the hole of the top flange of the double channel and securely screwed into camlock 46. One ⅜" flat washer 62 and one ⅜-16" UNC hexagon nut 56 are then installed onto the end of the all thread rod protruding through the structural steel. All nuts are then tightened, creating a secure mechanical anchorment between the structural steel frame and insulated panels.

We claim:

1. A ceiling or wall panel assembly comprising:

a) a structural support having a planar upper surface;

b) a flanged spacer member supported upon and extending longitudinally away from said upper surface of said structural support;

c) first and second adjacent panel members supported on said spacer member, said first panel member further including:

i) a camlock for joining said first and second panels including a locking piece extensible into a complementary lock piece in said second panel member, said camlock further including a threaded inner wall defining a vertical opening within said camlock; and d) a thread rod extending longitudinally through said structural support and said spacer member, into said first panel member, a portion of said thread rod further extending into said vertical opening within said camlock, in threaded engagement with said inner wall, said thread rod being secured against vertical or rotational movement relative to said structural support and said first and second panel members.

2. The assembly of claim 1, wherein said spacer member further includes first and second upper and lower flanges in a double channel configuration.

3. The assembly of claim 1, wherein said thread rod is secured against movement by means of a plurality of hexagon nuts located on said thread rod.

4. The assembly of claim 1, further including silicone sealant within said first panel member engaging a portion of said thread rod extending within said first panel member.

5. The assembly of claim 1, wherein said support comprises a structural steel frame.

6. The assembly of claim 1, wherein said opening defined by said inner walls of said camlock is of generally polygonal configuration.

7. The assembly of claim 6, wherein said opening comprises a ⅜"-16 tapped hexagon hole.

8. The assembly of claim 1, wherein said first and second adjacent panel members comprise insulated, prefabricated panels.

9. The assembly of claim 8, further including at least one gasket member interposed between the said adjacent panel members.

10. The assembly of claim 2, further including at least one sheet metal screw penetrating the upper flange of said spacer member and the lower surface of said second panel member.

* * * * *